US006167726B1

(12) United States Patent
Kremer

(10) Patent No.: US 6,167,726 B1
(45) Date of Patent: Jan. 2, 2001

(54) RING WITH ROTATING BEAD

(76) Inventor: Frederick Joseph Kremer, 1606 Rosewood Ave., Louisville, KY (US) 40204

( * ) Notice: Under 35 U.S.C. 154(b), the term of this patent shall be extended for 0 days.

(21) Appl. No.: 09/392,423

(22) Filed: Sep. 9, 1999

Related U.S. Application Data

(60) Provisional application No. 60/107,917, filed on Nov. 10, 1998.

(51) Int. Cl.[7] ..... A44C 17/02

(52) U.S. Cl. ..... 63/31; 63/15; 63/26; 63/28

(58) Field of Search ..... 63/15, 26, 28, 63/31, 38, 3, 4

(56) References Cited

U.S. PATENT DOCUMENTS

| | | | | |
|---|---|---|---|---|
| D. 176,265 | | 12/1955 | Katz . | |
| D. 176,268 | | 12/1955 | Katz . | |
| D. 177,384 | | 4/1956 | Katz . | |
| D. 197,576 | | 2/1964 | Katz . | |
| D. 304,912 | | 12/1989 | Wood . | |
| D. 318,818 | | 8/1991 | Bulgari . | |
| 922,212 | | 5/1909 | Tropin . | |
| 1,032,025 | | 7/1912 | Robbins . | |
| 1,550,011 | | 8/1925 | Cobb . | |
| 1,672,355 | * | 6/1928 | Ullman | 63/1.13 |
| 1,827,695 | * | 10/1931 | Welch | 63/32 |
| 1,920,875 | | 8/1933 | Miskend . | |
| 2,185,811 | * | 1/1940 | Heyman | 63/1.12 |
| 2,585,183 | * | 2/1952 | Stern | 63/15 |
| 3,081,997 | * | 3/1963 | Glass et al. | 472/70 |
| 3,739,598 | * | 6/1973 | Postel | 63/29.1 |
| 3,959,989 | * | 6/1976 | Bhandia | 63/15.65 |
| 4,764,140 | | 8/1988 | Wood . | |
| 4,977,757 | | 12/1990 | Mesica et al. . | |
| 5,433,090 | * | 7/1995 | Santiago | 63/29.1 |
| 5,669,240 | * | 9/1997 | Lima | 63/15 |
| 5,787,731 | | 8/1998 | Ebara . | |
| 5,996,374 | * | 12/1999 | Bardisbanyan | 63/15 |
| 6,065,971 | * | 5/2000 | Lennon | 434/246 |

* cited by examiner

*Primary Examiner*—Terry Lee Melius
*Assistant Examiner*—Andrea Chop
(74) *Attorney, Agent, or Firm*—Theresa Fritz Camoriano; Camoriano and Associates

(57) ABSTRACT

A ring is provided with one or more rotatable beads projecting less than halfway out of the outer surface of the ring. There is a hole extending through each ring and an axle extending through the hole and anchored to the ring body. Where there is a plurality of beads, the axes of rotation of the beads lie parallel to each other.

8 Claims, 2 Drawing Sheets

RING WITH ROTATING BEAD

This application claims priority from Ser. No. 60/107,917, filed Nov. 10, 1998.

BACKGROUND OF THE INVENTION:

The present invention relates to rings, and, in particular, to a ring with one or more rotatable beads encased in the ring.

Various rings are known, and some have beads that can move relative to the ring body. However, these rings either do not provide sufficient protection against the wear and abrasion of the bead as the bead moves, or they do not sufficiently encase the bead. U.S. Pat. No. 1,920,875 "Miskend" shows a ring which must flex in order to receive the bead. In this arrangement, the bead is almost entirely exposed, so that the bead is not encased by the setting. U.S. Pat. No. 1,550,011 "Cobb" shows a bead that is encased in a setting. The bead is free to rotate in any direction, which is the purpose of this design. However, such freedom of movement means that the bead is likely to abrade against the ring, causing damage and wear to the bead or the ring, and the bead may become jammed against the ring, making rotation difficult.

SUMMARY OF THE INVENTION:

The present invention provides a ring with one or more rotatable beads embedded in the ring body. The bead is mounted for rotation about an axle, which protects the bead from wear and tear against the body of the ring as it is rotated. The bead is also encased more than halfway into the ring, so that it projects less than halfway out of the outer surface of the ring. This forms an attractive arrangement and provides protection for the bead. In a preferred embodiment in which there are two or more beads, the beads are mounted so as to rotate about parallel axes, so that a person can rotate the beads with a single motion.

DESCRIPTION OF THE PREFERRED EMBODIMENTS:

FIGS. 1–5 show a first embodiment of a ring 10 made in accordance with the present invention, and FIGS. 6–11 show a second embodiment of a ring 110 made in accordance with the present invention.

Looking first at FIGS. 1–5, the ring 10 has an inner surface 11 and an outer surface 13. There are two recesses

Figure 1:
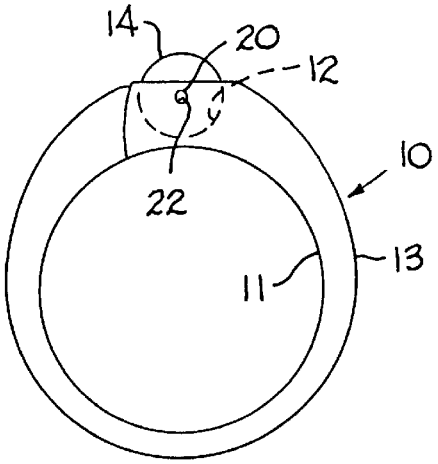
FIG. 1 is a front view of a ring made in accordance with the present invention.
Figure 2:
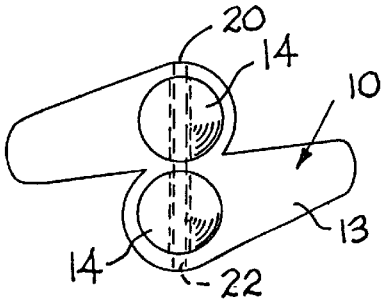
FIG. 2 is a top view of the ring of FIG. 1.
Figure 3:
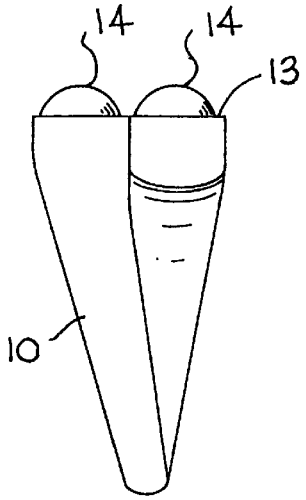
FIG. 3 is a side view of the ring of FIG. 1.
Figure 4:
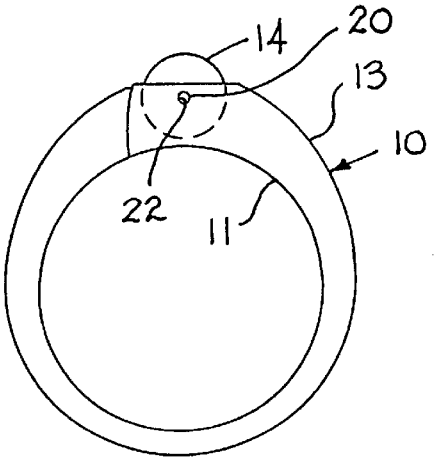
FIG. 4 is a rear view of the ring of FIG. 1.
Figure 5:
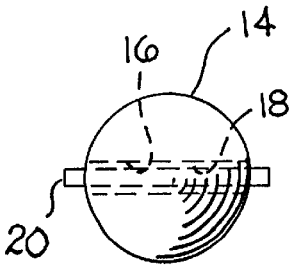
FIG. 5 is a view of one of the beads of the ring of FIG. 1.
Figure 6:
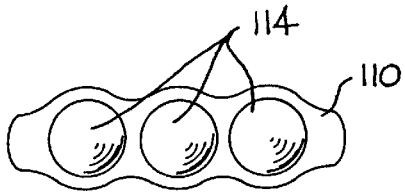
FIG. 6 is a top view of a second embodiment of a ring made in accordance with the present invention.
Figure 7:
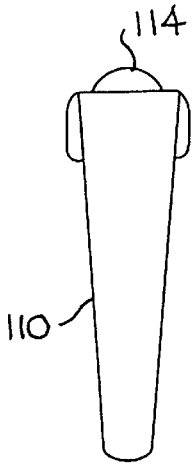
FIG. 7 is a right side view of the ring of FIG. 6.
Figure 8:
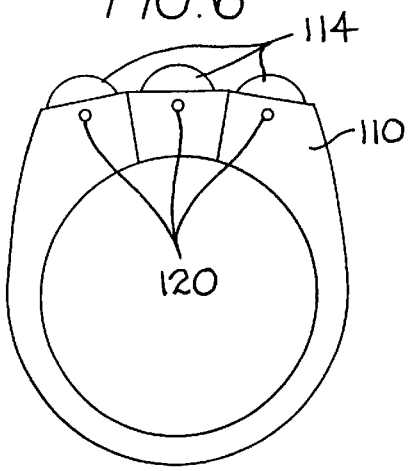
FIG. 8 is a front view of the ring of FIG. 6.
Figure 9:
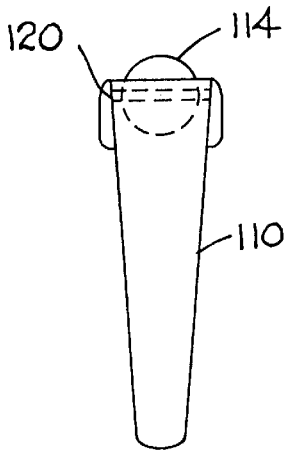
FIG. 9 is a left side view of the ring of FIG. 6.
Figure 10:
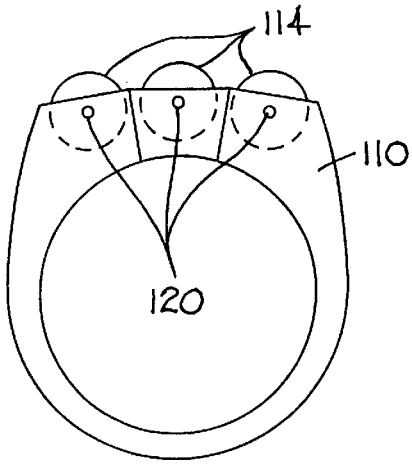
FIG. 10 is a rear view of the ring of FIG. 6.
Figure 11:
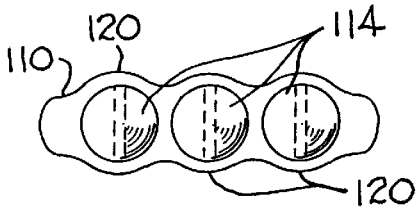
FIG. 11 is the same view as FIG. 6, but showing the axles in phantom.

12 from the outer surface 13, each of which receives a bead 14. One of the recesses 12 is shown in FIG. 1, and the second recess 12 is identical to the first and lies directly behind it. Each bead 14 is encased more than half-way into the ring so that less than half of the bead projects outwardly from the outer surface 13, and each bead 14 has its own separate receptacle 12 in the body of the ring, so that the beads are not adjacent to each other but rather are separately encased by the ring body. In this preferred embodiment, the ring body 10 is solid, but the ring body may also be hollow, as is known in the art. The ring 10 may be made out of gold, silver, platinum, or other desired material. The beads 14 may be natural, synthetic, or simulated gemstones or other suitable materials. As shown in FIG. 5, each bead 14 has a hole 16 through its diameter. A tube 18, made of gold, silver, platinum, or other desired materials preferably fits snugly into the hole 16 and is fixed to the bead 14 by an interference fit, by epoxy, or by other known means. A wire rivet or screw 20 extends through the tube 18 and into the ring 10 to secure the bead 14 to the ring 10. Small holes 22 may be drilled in the ring 10 to receive the rivet or screw 20. In this preferred embodiment, a single rivet 20 extends through and provides axles for both beads 14 on the ring 10, so that both beads 14 are rotatable about the same axis. Since they rotate about the same axis, the axes of rotation of the beads are parallel to each other. This is appealing to the wearer of the ring, because he or she can rotate both beads with a single motion.

Once the ring and beads are assembled, a wearer can wear the ring 10 and can rotate the beads 14 while wearing the ring 10. So, the ring is both attractive and functional. The beads will not abrade against the ring, because they are restricted against any movement other than rotation about the axles 20. They also will not abrade against the axle 20, because they are protected by the tube 18.

Looking next at FIGS. 6–11, the second embodiment of a ring 110 is very similar to the first embodiment, except that it has three beads 114. Of course, any number of beads of this type could be put on a ring, and these beads could be interspersed with other mountings, if desired. The beads 114 of this embodiment are identical to the beads 14 of the previous embodiment. Each bead 114 is rotatably mounted on a shaft 120, which is fixed to the ring 110, so that the wearer can rotate the beads 114 while wearing the ring 110. As with the previous embodiment, the axles 120 are inserted through tubes (not shown), which are fixed to the beads 114. The beads 114 shown here are spherical, but they may also be substantially spherical with facets. It is most desirable that the beads be symmetrical about their axis of rotation. The axles 120 are parallel to each other, and the axles 120 are anchored in bores in the ring body, so the axes of rotation of the beads 114 are parallel to each other.

It will be obvious to those skilled in the art that modifications may be made to the embodiments described above without departing from the scope of the present invention.

What is claimed is:

1. A ring, comprising:

a ring body, including an inner surface for receiving a person's finger, and an outer surface defining at least one recess for receiving a bead;

a bead inserted into said recess and enclosed by said ring body, so that less than one-half of the bead projects out of the recess and is exposed to view;

a hole extending through said bead;

an axle having two ends, said axle extending through said hole and secured to the ring body at both ends so that said bead is rotatable relative to said ring body about said axle.

2. A ring as recited in claim 1, and further comprising a tube extending through said hole and surrounding said axle.

3. A ring a s recited in claim 2, wherein said tube is fixed to said bead.

4. A ring as recited in claim 1, and further comprising a second recess in said outer surface and a second bead rotatably mounted in said second recess, wherein said second bead is restricted to rotation about an axis that is parallel to the axle of the first bead.

5. A ring, comprising:

a ring body, defining an inner surface for receiving a person's finger and an outer surface;

a bead substantially enclosed by said ring body and projecting less than halfway out of said outer surface so that less than half of said bead is exposed to view; said bead being rotatably mounted on said ring body by means of an axle extending through a hole in said bead.

6. A ring as recited in claim 5, wherein said ring body defines a bore for receiving said axle.

7. A ring as recited in claim 5, and further comprising a tube anchored in the hole in said bead, wherein said axle extends through said tube.

8. A ring, comprising:

a ring body, defining an inner surface for receiving a person's finger and an outer surface;

a plurality of beads, each bead being individually enclosed in said ring body and projecting less than halfway out of said outer surface so that less than one half of the outer surface of each bead is exposed to view, each of said beads defining a central hole;

an axle extending through the central hole of each bead and anchored in said ring body, wherein said beads are rotatable relative to said ring body about parallel axes of rotation.

* * * * *

UNITED STATES PATENT AND TRADEMARK OFFICE

CERTIFICATE OF CORRECTION

PATENT NO. : 6,167,726 B1
DATED : January 2, 2001
INVENTOR(S) : Frederick Joseph Kremer It is certified that error appears in the above-identified patent and that said Letters Patent is hereby corrected as shown below:

Column 3,
Line 3, delete “a s” and insert therefor -- as --.

Signed and Sealed this

Third Day of August, 2004

JON W. DUDAS
*Acting Director of the United States Patent and Trademark Office*